US009877119B2

(12) United States Patent
Ozden

(10) Patent No.: US 9,877,119 B2
(45) Date of Patent: Jan. 23, 2018

(54) HEARING AID WITH ANTENNA ON PRINTED CIRCUIT BOARD

(71) Applicant: GN Hearing A/S, Ballerup (DK)

(72) Inventor: Sinasi Ozden, Rodovre (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/983,253

(22) Filed: Dec. 29, 2015

(65) Prior Publication Data

US 2017/0180884 A1 Jun. 22, 2017

(30) Foreign Application Priority Data

Dec. 21, 2015 (DK) ..... PA 2015 70841
Dec. 21, 2015 (EP) ..... 15201496

(51) Int. Cl.
*H04R 25/00* (2006.01)
*H04R 5/00* (2006.01)

(52) U.S. Cl.
CPC ..... *H04R 25/552* (2013.01); *H04R 25/658* (2013.01); *H04R 2225/51* (2013.01)

(58) Field of Classification Search
CPC ..... H04R 2225/51
See application file for complete search history.

(56) References Cited

U.S. PATENT DOCUMENTS

2011/0260929 A1 10/2011 Ali et al.
2012/0026048 A1 2/2012 Vazques et al.
2012/0087506 A1 4/2012 Ozden
2012/0093324 A1* 4/2012 Sinasi ..... H01Q 1/273 381/23.1
2012/0268330 A1* 10/2012 Irmscher ..... H01Q 1/243 343/702
2013/0308805 A1 11/2013 Ozden
2015/0296312 A1 10/2015 Nikles et al.
2017/0027812 A1* 2/2017 Hyde ..... A61H 23/004

FOREIGN PATENT DOCUMENTS

EP 2 458 674 A2 5/2012
EP 2 458 674 A3 4/2014
EP 2 824 942 A1 1/2015
WO WO 2006/020923 A2 2/2006
WO WO 2006/020923 A3 2/2006

OTHER PUBLICATIONS

Extended European Search Report dated Mar. 30, 2016 for corresponding EP Patent Application No. 15201496.5, 8 pages.
First Technical Examination and Search Report dated Jul. 7, 2016 for corresponding Danish Patent Application No. PA 2015 70841, 6 pages.
Notification of Transmittal of the International Search Report and the Written Opinion dated May 24, 2017, for corresponding PCT Patent Application No. PCT/EP2016/081236, 15 pages.

* cited by examiner

*Primary Examiner* — Regina N Holder
(74) *Attorney, Agent, or Firm* — Vista IP Law Group, LLP

(57) ABSTRACT

A hearing aid includes: a microphone configured to receive sound; a processing unit configured to provide a processed audio signal for compensating a hearing loss of a user; a printed circuit board comprising a first layer; an antenna provided as an electrically conductive material on the first layer; a wireless communication unit for wireless communication; one or more flexible printed circuit board having a first flexible printed circuit board; and a polarization element configured for forming a polarization of the antenna, where the polarization element is on the first flexible printed circuit board.

16 Claims, 5 Drawing Sheets

HEARING AID WITH ANTENNA ON PRINTED CIRCUIT BOARD

RELATED APPLICATION DATA

This application claims priority to, and the benefit of, Danish Patent Application No. PA 2015 70841 filed Dec. 21, 2015, pending, and European Patent Application No. 15201496.5 filed Dec. 21, 2015, pending. The entire disclosures of both of the above applications are expressly incorporated by reference herein.

FIELD

The present disclosure relates to a hearing aid, such as a behind-the-ear hearing aid, comprising a microphone configured to receive sound. The hearing aid comprises a processing unit configured to provide a processed audio signal for compensating a hearing loss of a user. More particularly, the hearing aid comprises a printed circuit board comprising a first layer. The hearing aid comprises an antenna provided as an electrically conducting material on the first layer.

The hearing aid may be used in a binaural hearing aid system. During operation, the hearing aid is worn in the ear of a user.

BACKGROUND

Hearing aids are very small and delicate devices and comprise many electronic and metallic components contained in a housing or shell small enough to fit in the ear canal of a human or be located behind the outer ear. The many electronic and metallic components in combination with the small size of the hearing aid housing or shell impose high design constraints on radio frequency antennas to be used in hearing aids with wireless communication capabilities.

Moreover, the antenna in the hearing aid has to be designed to achieve a satisfactory performance despite these limitations and other high design constraints imposed by the size of the hearing aid.

The developments within wireless technologies for hearing devices and the continuous efforts to make hearing devices smaller and more cost effective to manufacture has led to the use of flexible carriers incorporating one or more antennas in hearing devices.

Still further, in binaural hearing aid systems, the requirements to the quality of the communication between the hearing aids in the binaural hearing aid system are ever increasing, and include demands for low latency and low noise, increasing the requests for effective antennas in the hearing aids.

SUMMARY

There is a desire for reducing the size of the electrical assembly of a hearing device.

There is a need for improved wireless communication in hearing aids.

It is an object to provide a hearing aid with reduced size of the electrical assembly of the hearing aid and with improved wireless communication capabilities, such as improved wireless communication capabilities between two hearing aids worn in or behind opposite ears of the user, and/or between a hearing aid and an accessory device.

Radio connectivity between hearing aids (HIs) allows for advanced binaural signal processing when the important ear-to-ear (E2E) link is ensured. Furthermore, the Hs may be connected to a plethora of accessories, that can be either body-worn or placed in the user's proximity, and hence to the internet as part of the so-called internet of things (IoT). However, it is challenging but of key importance to ensure a stable E2E link. The 2.4 GHz ISM band is preferred due to the presence of many harmonized standards for low-power communications, such as BLE or ZigBee, its worldwide availability for industrial use, and the trade-off between power consumption and range that can be achieved. The E2E link is particularly demanding in terms of requirements on the wearable antenna design and performance. In fact, in order to achieve a good on-body performance, the antenna needs to exhibit optimal radiation efficiency, bandwidth, polarization, and radiation pattern, while the volume available for the design is extremely reduced, as most times space comes at a premium in wearable devices such as in hearing aid, in particular in ITE hearing aids. Furthermore, mass production and industrial design needs demand the antenna to be as well low-profile, lightweight, and inexpensive to manufacture. In particular, the antenna polarization characteristic is an important performance parameter. More overall constrains may also be relevant. In fact, the efficiency may be seriously jeopardized by the proximity of the antenna to the human head, as the body tissues have very high losses around 2.4 GHz due to the high water content. This may critically impact the overall performance given the magnitude of the drop in efficiency and the fact that the HI radios operate in ultra-low-power regime. Another issue threatening antenna efficiency is the little volume available for the design, as this necessarily brings the antenna in close physical, hence, electrical as well, proximity of other parts of the device, with a strong likelihood of coupling to them. A large bandwidth is as well hard to achieve for an electrically small antenna (ESA), due to its fundamental limits. The bandwidth may cover at least the whole 2.4 GHz ISM band, but a larger bandwidth would help to compensate for the detuning of the antenna caused by the body, that varies across users.

In accordance with the present disclosure, the above-mentioned and other objects are obtained by a behind-the-ear hearing aid.

Disclosed is a hearing aid comprising a microphone configured to receive sound. The hearing aid comprises a processing unit configured to provide a processed audio signal for compensating a hearing loss of a user. The hearing aid comprises a printed circuit board comprising a first layer. The hearing aid comprises an antenna provided as an electrically conductive material on the first layer. The hearing aid comprises a wireless communication unit for wireless communication. The hearing aid comprises a polarization element configured for forming the polarization of the antenna, where the polarization element is provided on a flexible printed circuit board, and where the flexible printed circuit board comprises at least a first flexible printed circuit board.

The hearing aid may be a behind-the-ear (BTE) hearing aid. The hearing aid may comprise a housing. The features of components of the hearing aid may be comprised, provided or arranged in the housing.

The processing unit is configured to process the sound received by the microphone to provide a processed audio signal for compensating a hearing loss of a user. The hearing aid may also comprise an output transducer for providing an acoustic output, i.e. the processed audio signal form the processing unit, to an ear of the user wearing the hearing aid in or behind or at his/her ear.

The hearing aid comprises a printed circuit board comprising a first layer. The antenna is provided as an electrically conductive material on the first layer. It an advantage that the antenna is provided on the first layer of the printed circuit board, as this means that the antenna can be short, such as shorter than the typical length of an antenna in a hearing aid, such as in a BTE hearing aid. Typically and in prior art the antenna is placed outside the printed circuit board, such as on the walls of the housing, on a cover element, attached to a wall and/or just freely floating in the housing, i.e. not being attached.

The hearing aid comprising a polarization element configured for forming the polarization of the antenna, where the polarization element is provided on a flexible printed circuit board, where the flexible printed circuit board comprises at least a first flexible printed circuit board. It is an advantage that due to the polarization element, the polarization of the antenna is configured to be formed or controlled or improved thereby providing ear-to-ear (E2E) capabilities of the hearing aid.

The flexible printed circuit board is configured to be retro fitted in the hearing aid after the actual manufacturing of the hearing aid. Alternatively, the flexible printed circuit board can be provided in the hearing aid when the hearing aid is manufactured.

It is an advantage that the flexible printed circuit board comprising the polarization element is configured to be retro-fitted in the hearing aid, as this provides for changing or upgrading a standard hearing aid to a high-end or higher-end hearing aid in an easy way.

The hearing aid comprises a wireless communication unit for wireless communication. The wireless communication, or radio, may be arranged on the printed circuit board.

According to a further aspect, a binaural hearing aid system is disclosed comprising a first and a second hearing aid as herein disclosed. Thus the first and/or second hearing aid may be a hearing aid as disclosed above.

Thus it is an advantage that the polarization of the antenna can be formed or controlled or directed, for example such that it is higher in an orthogonal direction or normal to the head of the user or to the surface of the head of the user. The polarization should be formed such that it improves the wireless communication between for example two hearing aids arranged in both ears of the user. The correct polarization of the antenna, e.g. a polarization which is higher in an orthogonal direction to the surface of the head of the user, is an advantage as this is optimal to excite a strong surface wave, i.e. electromagnetic wave, along the body, such as along the face of the user, such as to the other ear of the user.

The wireless communication between two hearing aids is an advantage as the hearing aids can communicate together, and such that each hearing aid does not need to be adjusted manually, but can be adjusted automatically due to the wireless communication with the hearing aid in the other ear. For example if the user turns his head, for example when he is in a conversation with another person, the ear pointing away from the sound source, e.g. the conversation partner, will receive less sound, and this ear will thus hear less. Normally the user will then turn up the volume of this hearing aid. However with the ear-to-ear technology the two hearing aids communicate wirelessly with each other and can automatically turn up and down the volume when needed.

The correct or optimal polarization of the antenna provided by the polarization element in the hearing aid(s) thus improves this wireless ear-to-ear communication between the hearing aids.

The polarization of the antenna corresponds or defines or determines the direction of the electric field or E-field.

The antenna is for emission and/or reception of an electromagnetic field being interconnected with one of the one or more wireless communication units.

The antenna may be an electric antenna. The antenna may be a monopole antenna.

The antenna may be a dipole antenna. The antenna may be a resonant antenna. The antenna may be a quarter-wave monopole antenna etc.

Thus it is an advantage that the antenna may be short, such as shorter than a loop antenna. When the antenna is short, the antenna does not require much space in the hearing aid and thus there are more options and flexibility with regards to the arrangement of the antenna and the relative arrangement of first antenna and the other components.

The antenna may be configured to have a first radiation pattern.

The near field pattern for the antenna may be a TM polarized near field. The first radiation pattern may be dominated by the E-field, so that a primary part of the overall electromagnetic field, such as more than 75%, such as more than 80%, such as more than 85%, such as more than 90% of the overall electromagnetic field, is contributed by the E-field.

The antenna may be a 2.4 GHz antenna. The antenna may be configured for radiation in a first frequency range. A second antenna may be provided, e.g. a magnetic antenna, and the second antenna may be configured for radiation in a second frequency range.

The antenna may be configured to operate in the first frequency range, such as at a frequency above 800 MHz, such as at a frequency above 1 GHz, such as at a frequency of 2.4 GHz, such as at a frequency between 1.5 GHz and 3 GHz, during use. Thus, the antenna may be configured for operation in ISM frequency band. The antenna may be any antenna capable of operating at these frequencies, and the antenna may thus be a resonant antenna, such as monopole antenna, such as a dipole antenna, etc. The resonant antenna may have a length of lambda/4 or any multiple thereof, lambda being the wavelength corresponding to the emitted electromagnetic field.

In present day communication systems, numerous different communication systems communicate at or about 2.4 GHz, and thus there is also a significant noise in the frequency range at or about 2.4 GHz. It is an advantage that for some applications for which the noise may be acceptable, for example for data communication, the antenna, such as an electrical antenna may be used. For other applications, in which a high noise level may impact the transmission significantly, a second antenna, such as a magnetic antenna may be used. For example, the second antenna may be used for streaming of audio.

The antenna may be configured for data communication at a first bit rate. In one or more embodiments, a second antenna may be provided and the second antenna may be configured for data communication at a second bit rate, the second bit rate being larger than the first bit rate, such as by a factor 10, such as by a factor 30, a factor 50, a factor 100, etc.

To improve the polarization of the antenna a polarization element is provided on a flexible printed circuit board.

This means that there will be at least some currents induced on the polarization element, and these currents have a direction between a first side and a second side of the hearing aid device in an E2E direction. The PCB antenna is placed so that it has current going in a non-E2E direction from a first end to an opposite second end, since otherwise the antenna cannot have the desired length. Thus the E2E current may be orthogonal relative to the direction of the antenna on the printed circuit board. This is an improvement compared to just having the antenna by itself, because the antenna by itself is placed in a plane, which has an orientation that means that the electric field transmitted by the antenna for the most part will be in the skin of the user, such as parallel to the surface of the user's head.

However, with a polarization element forming the polarization of the antenna, where the polarization element is provided on the flexible printed circuit board, the electric field can be oriented or directed or turned so that it becomes more orthogonal to the surface, and thus skin, of the user's head. This is advantageous, because skin has many charges which will attenuate the electric field if it is oscillating in the surface skin of the user as it travels along the body and face.

The hearing aid or housing may comprise a first side and a second side, where the first side and the second may be arranged opposite each other. The first side and the second side may be arranged in an E2E direction when the hearing aid is worn by the user. The hearing aid or housing may comprise a first end and a second end, where the first end and the second end may be arranged opposite each other. The first end and the second end may be arranged in a non-E2E direction when the hearing aid is worn by the user. The E2E direction and the non-E2E direction may be orthogonal relative to each other, such as substantially orthogonal, such as orthogonal within 20 degrees, or within 10 degrees, or within 5 degrees. The first and the second side may be orthogonal relative to the first and the second end, such as substantially orthogonal, such as orthogonal within 20 degrees, or within 10 degrees, or within 5 degrees.

The hearing aid may be a Behind-The-Ear (BTE) hearing aid.

The hearing aid may comprise the printed circuit board having a first board surface and a second board surface. The second board surface may be parallel to the first board surface.

The hearing aid may comprise the flexible printed circuit board, also denoted flexible carrier. The flexible printed circuit board may have a thickness in the range from 5 μm to 1,000 μm. The flexible printed circuit board may be a sheet. In an exemplary electrical assembly, the flexible printed circuit board has a thickness in the range from 12 μm to 600 μm, such as 50 μm, 100 μm, 200 μm, 300 μm, 400 μm, 500 μm or any ranges therebetween. The flexible printed circuit board may have a first flexfilm surface and a second flexfilm surface.

The electrically conducting material may be solder material such as a solder alloy, e.g. comprising one or more of zinc, tin, silver, copper and lead.

The diameter at the first end and/or second end of the hearing aid is typically less than 7 mm. The distance between the first end and the second end of the hearing aid is typically also 7 mm A printed circuit board may be provided in the hearing aid. The antenna may be connected to the circuit board with a wire. The circuit board may have a matching circuit, a balun and a radio, such as a wireless communication unit.

The polarization element can be connected to ground or it can be floating, i.e. not connected to ground.

The hearing aid may comprise a battery. The battery may have a first side and a second side. The battery may be provided at the second end of the hearing aid.

The battery may be a flat battery, such as a button shaped battery. The battery may be circular. The battery may be a disk-shaped battery.

The hearing aid may be any hearing aid, such as a hearing aid of the in-the-ear type, such as in-the-canal type, such as completely-in-the-canal type of hearing aid, etc., a hearing aid of the behind-the-ear type, of the receiver-in-the-ear type of hearing aid, etc.

One or more wireless communications unit(s) are configured for wireless data communication, and in this respect interconnected with the antenna for emission and reception of an electromagnetic field. Each of the one or more wireless communication units may comprise a transmitter, a receiver, a transmitter-receiver pair, such as a transceiver, a radio unit, etc. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

The processing unit may be provided on a printed circuit board.

The term sound and/or the term acoustic output may be understood to be an audio signal. Thus the microphone may be configured to receive sound or an audio signal. The output transducer may be configured to provide or transmit an acoustic output or a processed audio signal, such as the processed audio signal provided by the processing unit. The acoustic output or processed audio signal may be provided or transmitted to an ear of the user wearing the hearing aid during use.

In some embodiments the polarization element provides that the polarization of the antenna is higher in an orthogonal direction to a surface of a user's head than in a direction parallel to the surface of the user's head, when the hearing aid is arranged in an ear of the user during use of the hearing aid.

Thus it is an advantage that the polarization of the antenna is higher in an orthogonal direction or normal to the head of the user or to the surface of the head of the user as this improves the wireless communication between for example two hearing aids arranged in both ears of the user. The orthogonal polarization of the antenna is an advantage as this is optimal to excite a strong surface wave, i.e. electromagnetic wave, along the body, such as along the face of the user, such as to the other ear of the user.

Thus the polarization of the antenna is primarily, mainly or substantially orthogonal or normal to the surface of the user's head. The polarization of the antenna is orthogonal to the surface of the head such as 10 degrees from orthogonal, such as 15 degrees orthogonal, such as 20 degrees orthogonal, such as 25 degrees orthogonal, such as 30 degrees orthogonal etc.

In some embodiments the polarization element comprises an electrically conductive material. Thus it is an advantage that the polarization element may be provided as an electrically conductive material. The electrically conducting material may be an electrically conductive metal, such as cobber, and/or another suitable material which is electrically conductive and can form the polarization of the antenna. The electrically conductive material may be in the form of a metallic sheet or surface.

In some embodiments the electrically conductive material(s) is/are a conductive trace. The conductive trace may be a wire. The conductive trace may be made of a metal, for example cobber and/or alloy comprising cobber. The antenna and/or the polarization element may be made of or comprise an electrically conductive material, such as a conductive trace. Thus the antenna and/or the polarization element may be made of a metal, such as cobber.

In some embodiments the hearing aid comprises a housing with one or more walls, and wherein the flexible printed circuit board is attached and/or mounted on at least a part of at least one of the one or more walls. The flexible printed circuit board may be attached or mounted on the inside or internal face or surface of the one or more walls.

In some embodiments the printed circuit board comprises a first pad, and wherein the polarization element comprises a first end, and wherein the first end is interconnected with the first pad. The first end of the polarization element may be termed a terminal, such as a first terminal. The interconnection may be a connection and/or a mounting and/or a soldering. As the printed circuit board and/or a part and/or layer of the printed circuit board functions as ground (potential), the polarization element will be connected to ground when connected to the printed circuit board at this first pad.

In some embodiments the printed circuit board comprises a second pad, and/or wherein the polarization element comprises a second end.

In some embodiments the second end of the polarization element is interconnected with the second pad. The interconnection may be a connection and/or a mounting and/or a soldering. As the printed circuit board and/or a part and/or layer of the printed circuit board functions as ground (potential), the polarization element will be connected to ground when connected to the printed circuit board at this second pad. If the first end of the polarization element is also interconnected with the second pad of the printed circuit board, the flexible printed circuit board may extend all the way around the housing from the first pad to the second pad of the printed circuit board, e.g. forming a closed flexible printed circuit board, and this provides a long polarization element which can provide a high current in an E2E direction, i.e. a current extending across the hearing aid device from a first side of the hearing aid, or hearing aid housing, to a second opposite side of the hearing aid, or hearing aid housing. The PCB antenna is placed so that it has current going in a non-E2E direction from a first end to an opposite second end, since otherwise the antenna cannot have the desired length. Thus the E2E current may be orthogonal relative to the direction of the antenna on the printed circuit board.

In some embodiments the flexible printed circuit board comprises a second flexible printed circuit board, and wherein the second end of the polarization element on the first flexible printed circuit board is arranged proximate to a second end of the polarization element on the second flexible printed circuit board to provide a capacitive coupling. The first and the second flexible printed circuits boards may be arranged on opposite walls of the housing and/or on the same wall of the housing. The second end of the polarization element on the first flexible printed circuit board is arranged proximate to a second end of the polarization element on the second flexible printed circuit board, where proximate may be such as opposite, such as exactly opposite, or such as displaced relative to each other along a line in a longitudinal direction of the housing. The capacitive coupling is thus between the second ends of the polarization elements, whereby the signal or current may jump from the second end of the polarization element of first flexible printed circuit board to the second end of the polarization element of the second flexible printed circuit board, and thereby providing the same function as a closed flexible printed circuit board, which provides a long polarization element which can provide a high current in an E2E direction, i.e. a current extending across the hearing aid device from a first side of the hearing aid, or hearing aid housing, to a second opposite side of the hearing aid, or hearing aid housing. The PCB antenna is placed so that it has current going in a non-E2E direction from a first end to an opposite second end, since otherwise the antenna cannot have the desired length. Thus the E2E current may be orthogonal relative to the direction of the antenna on the printed circuit board. A closed flexible printed circuit board may be implemented as disclosed in the previous embodiment, where the first end of the polarization element is interconnected with the first pad of the printed circuit board, and where the second end of the polarization element is interconnected with the second pad of the printed circuit board.

It is an advantage of the present embodiment, i.e. where the flexible printed circuit board comprises a second flexible printed circuit board, and wherein the second end of the polarization element on the first flexible printed circuit board is arranged proximate to a second end of the polarization element on the second flexible printed circuit board to provide a capacitive coupling, that it may be easier to mount two smaller flexible printed circuit boards in the hearing aid housing than one larger and/or longer flexible printed circuit board.

In some embodiments the flexible printed circuit board comprising the polarization element is configured to be retro-fitted to the hearing aid and/or housing. Thus it is an advantage that the flexible printed circuit board can be retro-fitted, thereby upgrading a standard hearing aid to a high-end or higher-end hearing aid with improved polarization of the antenna and thereby ear-to-ear capabilities etc.

In some embodiments the antenna has a longitudinal extension in a first direction. Typically the antenna currents will be in a non-ear-to-ear direction, otherwise the antenna cannot have the desired long length along the printed circuit board.

In some embodiments the first direction of the longitudinal extension of the antenna is parallel to a longitudinal extension of the printed circuit board.

In some embodiments the first direction of the longitudinal extension of the antenna is in a plane parallel to a longitudinal extension of the hearing aid housing.

In some embodiments the polarization element has a longitudinal extension in a second direction and/or third direction.

In some embodiments the first direction of the longitudinal extension of the antenna is in a plane normal to the second direction and/or third direction of the polarization. element. In a plane normal to may means substantially normal, such as normal within 20 degrees, 15 degrees, 10 degrees, 5 degrees etc. However, the first direction and/or the second direction and/or the third direction can be non-normal or non-orthogonal to each other, such as 30 degrees, 45 degrees, 60 degrees etc.

In some embodiments a first end of the antenna is connected with the first end of the polarization element thereby extending a functional length of the antenna.

The antenna may be connected such as interconnected or mounted or soldered to the polarization element. As both the polarization element and the antenna may be made of an electrically conductive material, the functional or actual length of the antenna is extended when the antenna is connected with the polarization element. It is an advantage that the antenna is as big or long as possible as the antenna will then cover a greater area where it can pick up or detect signals, such as electrical signals. It is an advantage that the position of the high current on the antenna can be controlled as this can also improve the polarization of the antenna. When the antenna is placed on a printed circuit board, the high current will typically be placed in an undesired position as the longitudinal extension of the antenna is typically in a direction parallel to the head of the user. If the antenna is extended by connecting it with the polarization element, the position of the high current on the antenna can be changed and thereby improved to be on the part of the extended antenna which is orthogonal to the head of the user. Thus it is advantage that the antenna can be extended and the polarization of the antenna can be controlled and improved.

In some embodiments the walls of the housing comprises an inner surface having an area, and wherein the flexible printed circuit board covers more than 20% of the area of the inner surface of the hearing aid, such as more than 30%, 40%, 50%, 60%, 70%, 80%, or 90%. The flexible printed circuit board may cover the whole area of the inner surface of the hearing aid. The flexible printed circuit board may covers less than 20%, such as less than 5%, or 10% of the inner surface of the hearing aid. The inner surface may be the inner surface of the hearing aid housing.

In some embodiments the antenna comprises a first end and a second end, and wherein the first end of the antenna may be connected to the polarization element.

In some embodiments the antenna has a longitudinal extension in a first direction, for example a non-E2E direction from a first end of the hearing aid housing to a second end of the hearing aid housing.

The antenna may have a longitudinal extension in a first direction. Thus, the antenna may have an overall longitudinal extension in a first direction. The direction may indicate a line or path along which the antenna is extending. For example, the overall length of the antenna may be larger than the overall width of the antenna indicating a longitudinal extension in the lengthwise direction.

Thus, for example, the antenna may comprise a first antenna element extending along a plane normal to the first end of the hearing aid. The first antenna element may extend along a plane parallel to a first axis. The first axis may extend from the first end of the hearing aid to the second end of the hearing aid. The antenna may comprise a second antenna element extending along a plane parallel to the first end of the hearing aid. The second antenna element may extend along a plane normal to the first axis.

It is an advantage that due to the polarization element, the polarization of the antenna can be formed to be higher in an orthogonal direction to a surface of the user's head than in a direction parallel to the surface of the user's head, when the hearing aid is arranged in an ear of the user during use of the hearing aid. This improves the wireless ear-to-ear communication between the ears of the user. If no polarization element is provided in the hearing aid, the polarization of the antenna would be mainly in a direction parallel to the surface of the user's head, when the hearing aid is arranged in the ear of the user during use, and this would not improve the wireless ear-to-ear communication between the ears of the user.

In some embodiments the hearing aid comprises a printed circuit board, where the printed circuit board comprises a ground plane.

The hearing aid may comprise hearing aid electronic components including the processing unit or signal processor. The hearing aid electronic components may be provided on a printed circuit board. The one or more wireless communication units or radios may be arranged on the printed circuit board.

The printed circuit board may be arranged between the first end and the second end of the hearing aid. The printed circuit board may be arranged in the first end of the hearing aid. The printed circuit board may be arranged in the second end of the hearing aid.

Typically there is no ground plane in a hearing aid, as a ground plane may be a conducting plane of infinite area or an area which is at least five wavelengths wide and five wavelengths long. However, a layer of the printed circuit board may work as or have the function of a ground plane. Thus the ground plane for the antenna may be whatever structure that the ground connection from the balun is connected to.

In some embodiments the antenna is connected to the ground plane of the circuit board.

In some embodiments the polarization element is connected to the ground plane of the circuit board.

Thus the polarization element can be connected to ground instead of just being floating, i.e. with no galvanic connection to anything else.

Alternatively, the antenna is not connected to the polarization element. Alternatively and/or additionally the second end of the antenna is connected to the polarization element. For example both the first end of the antenna and the second end of the antenna is connected to the polarization element.

In some embodiments the antenna is placed on a layer of the printed circuit board (PCB). The antenna may be implemented as an electrically conductive material, such as a copper trace, interconnected with the radio via matching components. The received/emitted electro magnetic field has a first polarization. A flexible printed circuit board also called a flex film can be placed within the housing of the hearing aid. The flexible printed circuit board may have a copper trace which functions as a polarization element. When placed in the housing the polarization of the antenna will change, because of the presence of the polarization element on the flexible printed circuit board. An end of the polarization element on the flexible printed circuit board can be soldered to the PCB so that there will be a connection to a ground potential, i.e. the ground potential layer of the PCB. With the flexible printed circuit board the electric field of the antenna will be polarized more parallel to a surface of the user's head than orthogonal to the surface of the head. It is advantage of flexible printed circuit board with the polarization element that it is possible to provide upgradeable hearing aids by retro-fitting the flexible printed circuit board in the hearing aid. The antenna on the PCB is simple to produce and cheap and can thus be provided in all produced devices. For higher end products the flexible printed circuit board with the polarization element can be added in the hearing aid to give E2E capabilities, i.e. obtaining better directionality etc.

In some embodiments a first flexible printed circuit board and a second flexible printed circuit board can be placed in the housing. Both flexible printed circuit boards have a polarization element, for example in the form of an electrically conductive material, such as a copper trace. The first ends of the traces can be interconnected with ground. The second ends of the traces can be placed proximate each other so there can be a capacitive coupling between them.

In some embodiments a single flexible printed circuit board with a polarization element, such as a copper trace is provided. Both the first end and the second end of the trace can be soldered to the PCB and thereby connected to a ground. The flexible printed circuit board allow for a long polarization element in the form of the trace that can give a high current of the antenna in an E2E direction, i.e. a current going across the hearing aid device from a first side to a second opposite side. The PCB antenna is placed in the hearing aid in a way where it has currents going in a non E2E direction, since otherwise the antenna cannot have the desired length. With the polarization element in the form of the trace provided on the flexible printed circuit board, the polarization of the antenna can be formed to be in the desired direction.

In some embodiments an extension of the length of the antenna is provided, which make the antenna more effective. The antenna on the PCB can have a length which is a quarter of a wavelength whereby the antenna can function alone. The polarization element in the form of a trace on the flexible printed circuit board can be three quarters of a wavelength, and when the end of the antenna is connected with the end of the polarization element, this provides a total functional length of the antenna to be one wavelength, i.e. a sphere enclosing the PCB antenna alone is smaller than the sphere enclosing the antenna and flexible printed circuit board trace. Thus the end, such as the first end, of the PCB antenna may be soldered together with the end, such as the first end, of the flex film antenna.

An advantage of the hearing aid(s) as disclosed herein is that an improved wireless ear-to-ear communication may be achieved for most head sizes, shapes and amount of hair. Human heads and human ears vary in size and shape and also the amount of hair varies from person to person. Hearing aids adapted for wireless communications may be susceptible to impairments of for example the ear-to-ear communication due to e.g. the head of the user. Radio waves from a hearing aid at one side may have to travel through or around the head in order to reach the hearing aid at the other ear. Therefore, the human head may be perceived as an obstacle to the ear-to-ear communication. It is an advantage that the polarization of the antenna as provided in the hearing aid improves the ear-to-ear communication.

In the following, an embodiment is described primarily with reference to a hearing aid, such as a binaural hearing aid. It is however envisaged that the disclosed features and embodiments may be used in combination with any aspect described herein.

The present disclosure relates to different aspects including the hearing aid described above and in the following, and corresponding methods, devices, systems, uses and/or product means, each yielding one or more of the benefits and advantages described in connection with the first mentioned aspect, and each having one or more embodiments corresponding to the embodiments described in connection with the first mentioned aspect and/or disclosed in the appended claims.

A hearing aid includes: a microphone configured to receive sound; a processing unit configured to provide a processed audio signal for compensating a hearing loss of a user; a printed circuit board comprising a first layer; an antenna provided as an electrically conductive material on the first layer; a wireless communication unit for wireless communication; one or more flexible printed circuit board having a first flexible printed circuit board; and a polarization element configured for forming a polarization of the antenna, where the polarization element is on the first flexible printed circuit board.

Optionally, the polarization element provides that the polarization of the antenna is higher in an orthogonal direction to a surface of a user's head than in a direction parallel to the surface of the user's head, when the hearing aid is arranged in an ear of the user during use of the hearing aid.

Optionally, the polarization element comprises an electrically conductive material.

Optionally, the electrically conductive material comprises a conductive trace.

Optionally, the hearing aid further includes a housing with one or more walls, and wherein the flexible printed circuit board is attached/mounted on at least a part of at least one of the one or more walls.

Optionally, the printed circuit board comprises a first pad, and wherein the polarization element comprises a first end, and wherein the first end is interconnected with the first pad.

Optionally, the printed circuit board comprises a second pad, and/or wherein the polarization element comprises a second end.

Optionally, the second end is interconnected with the second pad.

Optionally, the one or more flexible printed circuit board comprises a second flexible printed circuit board having an additional polarization element, and wherein a second end of the polarization element on the first flexible printed circuit board is arranged proximate to a second end of the additional polarization element on the second flexible printed circuit board to provide a capacitive coupling.

Optionally, the flexible printed circuit board comprising the polarization element is configured to be retro-fitted to the hearing aid.

Optionally, the antenna has a longitudinal extension in a first direction.

Optionally, the first direction of the longitudinal extension of the antenna is parallel to a longitudinal extension of the printed circuit board.

Optionally, the hearing aid further includes a hearing aid housing, and wherein the first direction of the longitudinal extension of the antenna is in a plane parallel to a longitudinal extension of the hearing aid housing.

Optionally, the polarization element has a longitudinal extension in a second direction and/or a third direction.

Optionally, an end of the antenna is connected with an end of the polarization element thereby extending a functional length of the antenna.

Other aspects and advantageous will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
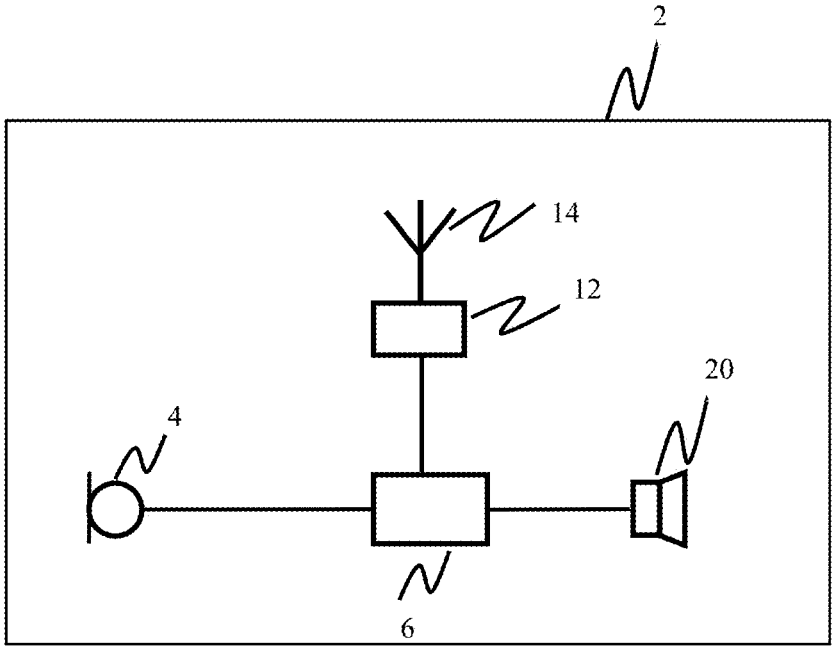
FIG. 1 schematically illustrates an exemplary hearing aid.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

As used herein, the term "antenna" refers to an electrical or magnetic device which converts electric or magnetic power into radio waves. An electric antenna may comprise an electrically conductive material connected to e.g. a wireless communications unit, such as a radio chip, a receiver or a transmitter. A magnetic antenna, such as a magnetic loop antenna, may comprise a coil of electrically conductive material wound around a core of magnetic material.

FIG. 1 schematically illustrates an exemplary hearing aid 2. The hearing aid 2 comprises a microphone 4 configured to receive sound, a processing unit 6 configured to provide a processed audio signal for compensating a hearing loss of a user, a printed circuit board (not shown) comprising a first layer (not shown), an antenna 12 provided as an electrically conductive material on the first layer, a wireless communication unit 14 for wireless communication, and a polarization element (not shown) configured for forming the polarization of the antenna 12. The hearing aid further comprises a output transducer or receiver 20, which may be arranged in the hearing aid housing or outside the hearing aid housing, such as in the ear of the user, while the hearing aid housing is configured to be arranged behind the ear of the user.

Figure 2:
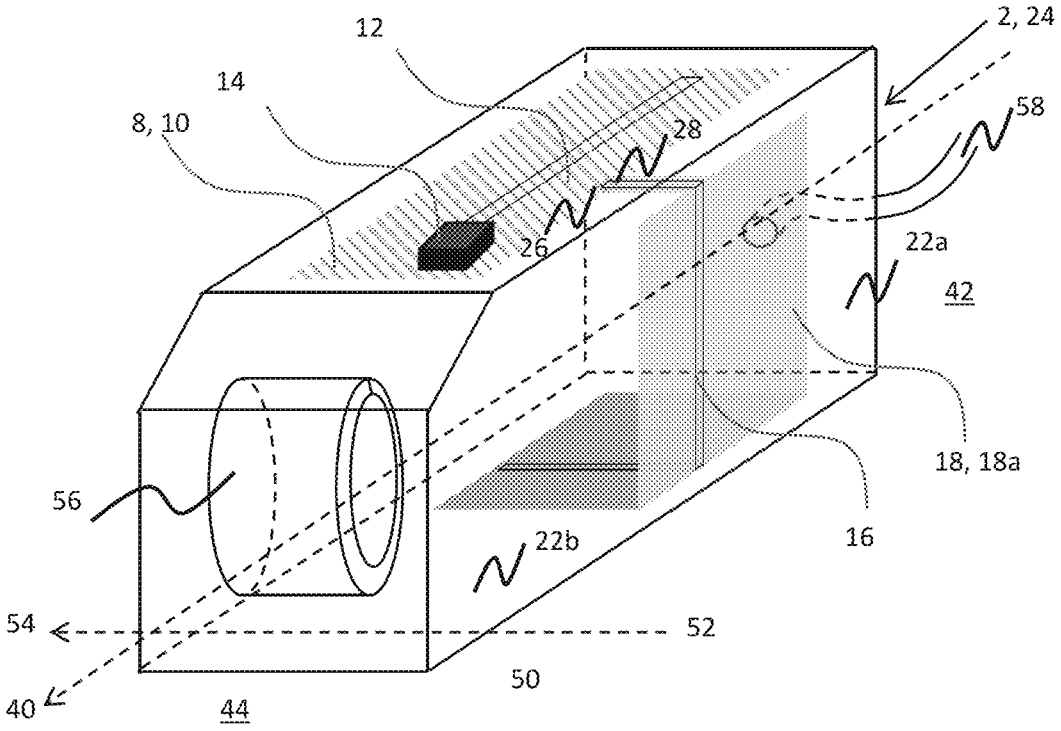
FIG. 2 schematically illustrates an exemplary hearing aid with a single flexible printed circuit board.

FIG. 2 schematically illustrates an exemplary hearing aid 2. The hearing aid comprises a microphone (not shown) configured to receive sound, a processing unit (not shown) configured to provide a processed audio signal for compensating a hearing loss of a user. The hearing aid 2 comprises a printed circuit board 8 comprising a first layer 10. An antenna 12 is provided as an electrically conductive material on the first layer 10. A wireless communication unit 14 or radio for wireless communication is provided, e.g. on the printed circuit board 8. The hearing aid 2 comprises a polarization element 16 configured for forming the polarization of the antenna 12. The polarization element 16 is provided on a flexible printed circuit board 18, and the flexible printed circuit board 18 comprises at least a first flexible printed circuit board 18*a*.

The hearing aid 2 comprises a housing 24 with a number of walls 22, and the flexible printed circuit board 18 is mounted on a part of two 22*a*, 22*b* of the one or more walls 22.

The printed circuit board 8 comprises a first pad 26. The polarization element 16 comprises a first end 28. The first end 28 of the polarization element 16 is interconnected with the first pad 26 of the PCB 8.

Thus the antenna 12 is placed on a layer 10 of the PCB 8. The antenna 12 may be a copper trace interconnected with the radio 14 via matching components. The received/emitted electro magnetic field of the antenna has a first polarization. The flexible printed circuit board 18 is placed within the housing 24 of the hearing aid 2. The flexible printed circuit board 18 may have a copper trace providing a polarization element 16. When the flexible printed circuit board 18 is placed in the housing 24 the polarization of the antenna 12 will change, because of the presence of the polarization element 16 on the flexible printed circuit board 18. A first end 28 of the trace providing the polarization element 16 on the flexible printed circuit board 18 can be soldered to a first pad 26 of the PCB 8 so that there will be a connection to a ground potential, i.e. the ground potential layer of the PCB 8. With the flexible printed circuit board 18 comprising the polarization element 16 the electric field of the antenna 12 will be polarized more parallel to a surface of the head than orthogonal to the surface of the head.

The antenna 12 has a longitudinal extension in a first direction along a first axis 40. The first direction of the longitudinal extension of the antenna 12 is parallel to a longitudinal extension of the printed circuit board 8. The first direction of the longitudinal extension of the antenna 12 is in a plane parallel to a longitudinal extension of the hearing aid housing 24. The polarization element 16 has a longitudinal extension in a second direction and/or third direction, which may be normal to the first direction along the axis 40.

The polarization element 16 can give a high current of the antenna 12 in an E2E direction 50, i.e. a current going across the hearing aid device or housing 24 from a first side 52 to a second opposite side 54. The PCB antenna 12 is placed so that it has current going in a non-E2E direction 40 from a first end 42 to an opposite second end 44, since otherwise the antenna 12 cannot have the desired length. Thus the E2E current is orthogonal relative to the direction of the antenna on the printed circuit board.

The hearing aid 2 may comprise a battery 56. The battery may be arranged in a second end 44 of the hearing aid housing 24.

The hearing aid may comprise a coupling element 58. If the hearing aid is a BTE hearing aid, the output transducer is arranged in the behind-the-ear part of the hearing aid, e.g. the housing 24, and the coupling element 58 is an acoustic coupling element directing the sound into the ear of the user. If the hearing aid is a receiver-in-the-canal (RIE), the output transducer is arranged in the ear of the user, and the coupling element 58 comprises wires (not shown) to the output transducer. The coupling element 58 may be arranged in a first end 42 of the hearing aid housing 24.

Figure 3:
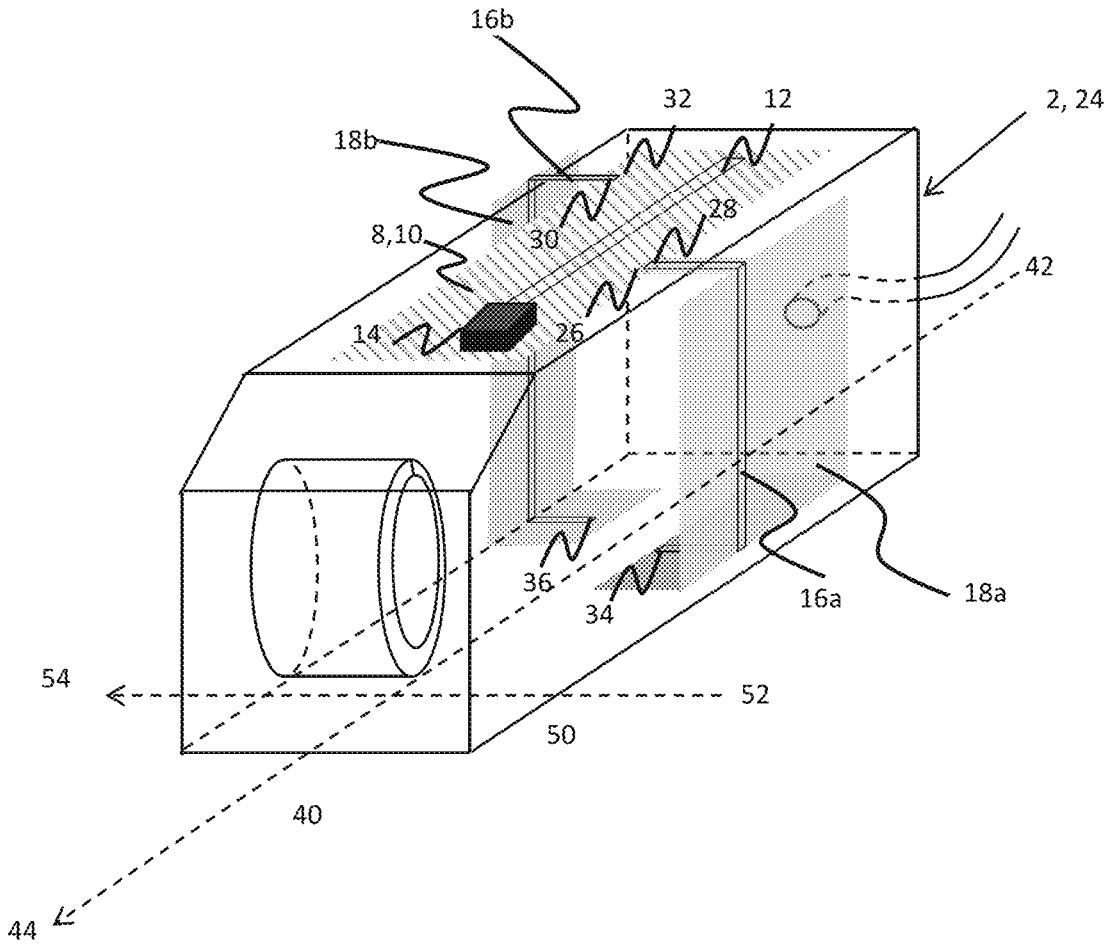
FIG. 3 schematically illustrates an exemplary hearing aid with two flexible printed circuit boards.

FIG. 3 schematically illustrates an exemplary hearing aid 2. The hearing aid 2 comprises a printed circuit board 8 comprising a first layer 10. An antenna 12 is provided as an electrically conductive material on the first layer 10. A wireless communication unit 14 or radio for wireless communication is provided, e.g. on the printed circuit board 8. The hearing aid 2 comprises a first flexible printed circuit board 18*a* and a second flexible printed circuit board 18*b* which are placed in a housing 24 of the hearing aid 2. Both flexible printed circuit boards 18*a*, 18*b* have a polarization element 16*a*, 16*b* in the form of an electrically conductive trace. The first ends 28, 30 of the polarization elements 16*a*,

16*b* may be can be soldered to a first pad 26 and to a second pad 32, respectively, of the PCB 8 so that there will be a connection to a ground potential, i.e. the ground potential layer of the PCB 8. The other ends 34, 36 of the polarizations elements 16*a*, 16*b* can be placed proximate each other so there can be a capacitive coupling between them. The capacitive coupling between the polarization elements 16*a*, 16*b* on the flexible printed circuit boards 18*a*, 18*b* allows for a functional long trace that can give a high current of the antenna 12 in an E2E direction 50, i.e. a current going across the hearing aid device or housing 24 from a first side 52 to a second opposite side 54. The PCB antenna 12 is placed so that it has current going in a non-E2E direction 40 from a first end 42 to an opposite second end 44, since otherwise the antenna 12 cannot have the desired length. Thus the E2E current is orthogonal relative to the direction of the antenna on the printed circuit board.

Figure 4:
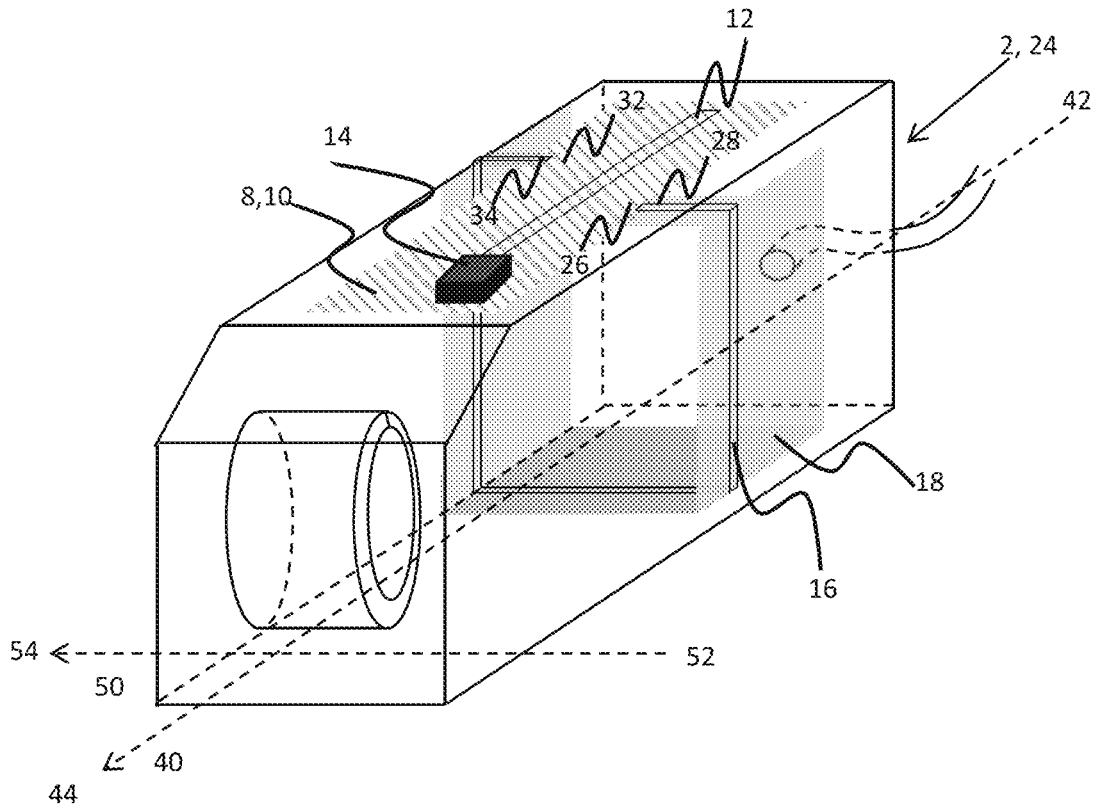
FIG. 4 schematically illustrates an exemplary hearing aid with a single flexible printed circuit board extending from a first pad of the printed circuit board to a second pad of the printed circuit board.

FIG. 4 schematically illustrates an exemplary hearing aid 2. The hearing aid 2 comprises a printed circuit board 8 comprising a first layer 10. An antenna 12 is provided as an electrically conductive material on the first layer 10. A wireless communication unit 14 or radio for wireless communication is provided, e.g. on the printed circuit board 8. The hearing aid 2 comprises a flexible printed circuit board 18 comprising a polarization element 16 having a first end 28 soldered to a first pad 26 of the printed circuit board 8. The polarization element 16 comprises a second end 34 soldered to a second pad 32 of the printed circuit board 8. Thus both ends 28, 34 of the trace forming the polarization element 18 can be soldered to the PCB and thereby connected to a ground. The flexible printed circuit board 18 allows for a long trace that can give a high current of the antenna 12 in an E2E direction 50, i.e. a current going across the hearing aid device or housing 24 from a first side 52 to a second opposite side 54. The PCB antenna 12 is placed so that it has current going in a non-E2E direction 40 from a first end 42 to an opposite second end 44, since otherwise the antenna 12 cannot have the desired length. Thus the E2E current is orthogonal relative to the direction of the antenna on the printed circuit board.

Figure 5:
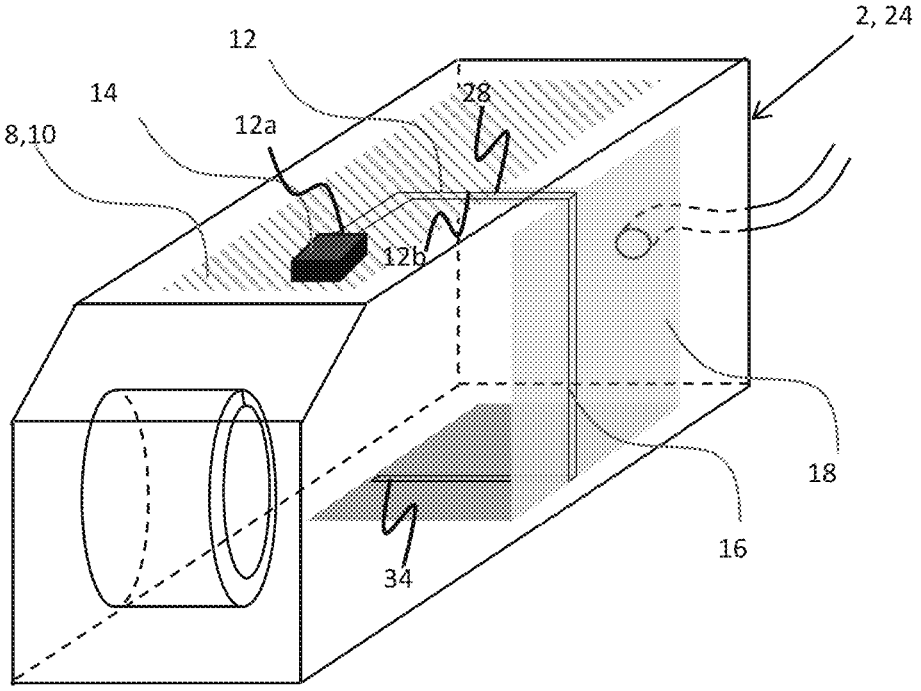
FIG. 5 schematically illustrates an exemplary hearing aid with an extended antenna.

FIG. 5 schematically illustrates an exemplary hearing aid 2. The hearing aid 2 comprises a printed circuit board 8 comprising a first layer 10. An antenna 12 is provided as an electrically conductive material on the first layer 10. A wireless communication unit 14 or radio for wireless communication is provided, e.g. on the printed circuit board 8. The hearing aid 2 comprises a flexible printed circuit board 18 comprising a polarization element 16 having a first end 28 connected, such as soldered, to a second end 12*b* of the antenna 12. The first end 12*a* of the antenna is connected to the radio 14. The polarization element 16 comprises a second end 34. Thus as the antenna 12 and the polarization element 16 are connected, this provides an extension of the length of the antenna 12, thereby making the antenna 12 more effective. The antenna 12 on the PCB 8 can have a length of one quarter of a wavelength thereby functioning alone. The polarization element 16 on the flexible printed circuit board 18 film can be three quarters of a wavelength giving a total functional length of the antenna 12 to be one wavelength, i.e. a sphere enclosing the PCB antenna 12 alone is smaller than the sphere enclosing the antenna 12 and polarization element 16.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing aid
4 microphone
6 processing unit
8 printed circuit board (PCB)
10 first layer
12 antenna
12*a* first end of antenna
12*b* second end of antenna
14 wireless communication unit or radio
16 polarization element
16*a* first polarization element
16*b* second polarization element
18 flexible printed circuit board or flex film
18*a* first flexible printed circuit board
18*b* second flexible printed circuit board
20 output transducer or receiver
22, 22*a*, 22*b* walls
24 housing
26 first pad of PCB
28 first end of (first) polarization element
30 first end of second polarization element
32 second pad of PCB
34 second end of (first) polarization element
36 second end of second polarization element
40 first axis/non-E2E direction
42 first end of housing/hearing aid
44 second end of housing/hearing aid
50 E2E direction
52 first side of housing/hearing aid
54 second side of housing/hearing aid
56 battery
58 coupling element

The invention claimed is:

1. A hearing aid comprising:
a microphone configured to receive sound;
a processing unit configured to provide a processed audio signal for compensating a hearing loss of a user;
a printed circuit board comprising a first layer;
an antenna provided as an electrically conductive material on the first layer, wherein a majority of a length of the antenna is in contact with the first layer of the printed circuit board;
a wireless communication unit for wireless communication;
one or more flexible printed circuit board having a first flexible printed circuit board; and
a polarization element configured for forming a polarization of the antenna, where the polarization element is on the first flexible printed circuit board.

2. The hearing aid according to claim 1, wherein the polarization element provides that the polarization of the antenna is higher in an orthogonal direction to a surface of a user's head than in a direction parallel to the surface of the user's head, when the hearing aid is arranged in an ear of the user during use of the hearing aid.

3. The hearing aid according to claim 1, wherein the polarization element comprises an electrically conductive material.

4. The hearing aid according to claim 3, wherein the electrically conductive material comprises a conductive trace.

5. The hearing aid according to claim 1, further comprising a housing with one or more walls, and wherein the flexible printed circuit board is attached/mounted on at least a part of at least one of the one or more walls.

6. The hearing aid according to claim 1, wherein the printed circuit board comprises a first pad, and wherein the polarization element comprises a first end, and wherein the first end is interconnected with the first pad.

7. The hearing aid according to claim 6, wherein the printed circuit board comprises a second pad, and/or wherein the polarization element comprises a second end.

8. The hearing aid according to claim 7, wherein the second end is interconnected with the second pad.

9. The hearing aid according to claim 1, wherein the one or more flexible printed circuit board comprises a second flexible printed circuit board having an additional polarization element, and wherein a second end of the polarization element on the first flexible printed circuit board is arranged proximate to a second end of the additional polarization element on the second flexible printed circuit board to provide a capacitive coupling.

10. The hearing aid according to claim 1, wherein the flexible printed circuit board comprising the polarization element is configured to be retro-fitted to the hearing aid.

11. The hearing aid according to claim 1, wherein the antenna has a longitudinal extension in a first direction.

12. The hearing aid according to claim 11, wherein the first direction of the longitudinal extension of the antenna is parallel to a longitudinal extension of the printed circuit board.

13. The hearing aid according to claim 11, further comprising a hearing aid housing, and wherein the first direction of the longitudinal extension of the antenna is in a plane parallel to a longitudinal extension of the hearing aid housing.

14. The hearing aid according to claim 11, wherein the polarization element has a longitudinal extension in a second direction and/or a third direction.

15. The hearing aid according to claim 1, wherein an end of the antenna is connected with an end of the polarization element thereby extending a functional length of the antenna.

16. The hearing aid according to claim 1, wherein the antenna comprises a copper trace on the first layer of the printed circuit board.

* * * * *